US006276960B1

(12) United States Patent
Schaefer et al.

(10) Patent No.: US 6,276,960 B1
(45) Date of Patent: Aug. 21, 2001

(54) ELECTRICAL POWER CONNECTOR SYSTEM

(75) Inventors: Christopher E. Schaefer, Warren; John M Sova, Cortland; James Okrucky, Warren, all of OH (US); Dane E. Carter; Robert C. Beer, both of Noblesville, IN (US); Michael L. Phifer, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/650,130

(22) Filed: Aug. 29, 2000

(51) Int. Cl.[7] ..... H01R 13/52; H01R 13/58; H01R 4/10

(52) U.S. Cl. ..... 439/522; 439/466; 439/843; 439/881

(58) Field of Search ..... 439/522, 881, 439/843, 855, 857, 682, 357, 358, 466, 754, 755, 764

(56) References Cited

U.S. PATENT DOCUMENTS

| | | | | |
|---|---|---|---|---|
| 4,113,337 | * | 9/1978 | McKee | 439/354 |
| 5,445,534 | * | 8/1995 | Ishizuka et al. | 439/352 |
| 5,515,064 | * | 5/1996 | Bacnik et al. | 343/860 |

* cited by examiner

*Primary Examiner*—Tulsidas Patel
*Assistant Examiner*—Chandrika Prasad
(74) *Attorney, Agent, or Firm*—Richard A. Jones

(57) ABSTRACT

A power connector system includes a female connector and a male connector. The female connector includes a female terminal in a female housing. The female terminal is in the form of a U-shaped channel defining a recess. A U-shaped contact member in the channel recess forms a second recess. The male connector includes a male terminal in a male housing. The male and female housings are releasably connected together with the male terminal extending into the recess in the contact member.

17 Claims, 5 Drawing Sheets

ELECTRICAL POWER CONNECTOR SYSTEM

FIELD OF THE INVENTION

This invention relates generally to an electrical power connector system and more particularly to an electrical power connector system that is adapted for use with automotive electrical storage batteries.

BACKGROUND OF THE INVENTION

A ring terminal type battery system has long been a standard in the industry. However, the ring terminal with bolt-on action has relatively high warranty costs due primarily to cross threading and stripping bolts. Assembly on the factory floor is also different. Also, with the standard ring terminal, the user is able to jump start a vehicle which can be undesirable in some instances. A direct connect system is needed which replaces the ring terminal type battery, lends itself to normal processing methods, can be made at a lower cost, and permits more convenient mating of the terminal parts with one another.

SUMMARY OF THE INVENTION

The connection system of this invention overcomes the shortcomings of previous systems. The system of this invention has no bolt-on action and does not permit a jump start. Preferably the system includes a female connector and a male connector. The female connector has a female terminal inside a female housing. A contact member is held by the female terminal. The male connector includes a male terminal inside a male housing. The male and female housings are releasably connected together with the male terminal engaging the contact member. A connection position assurance device (CPA) is provided to assure the connection between the male and female housings.

Preferably the male terminal is in the form of a single blade, and the female terminal is in the form of a generally U-shaped channel defining a recess. The contact member is also generally U-shaped and is releasably received in the recess of the channel. The single blade male terminal extends into a second recess formed by the U-shaped contact member.

One object of this invention is to provide a direct connect power battery system having the foregoing features and capabilities.

Another object is to provide a direct connect power battery system which is composed of a relatively few simple parts, is rugged and durable in use, and is capable of being easily manufactured and assembled.

These and other objects, features and advantages of the invention will become more apparent as the following description proceeds, especially when considered with the accompanying claims and drawings.

DETAILED DESCRIPTION OF THE PREFERRED EMBODIMENT

Figure 1:
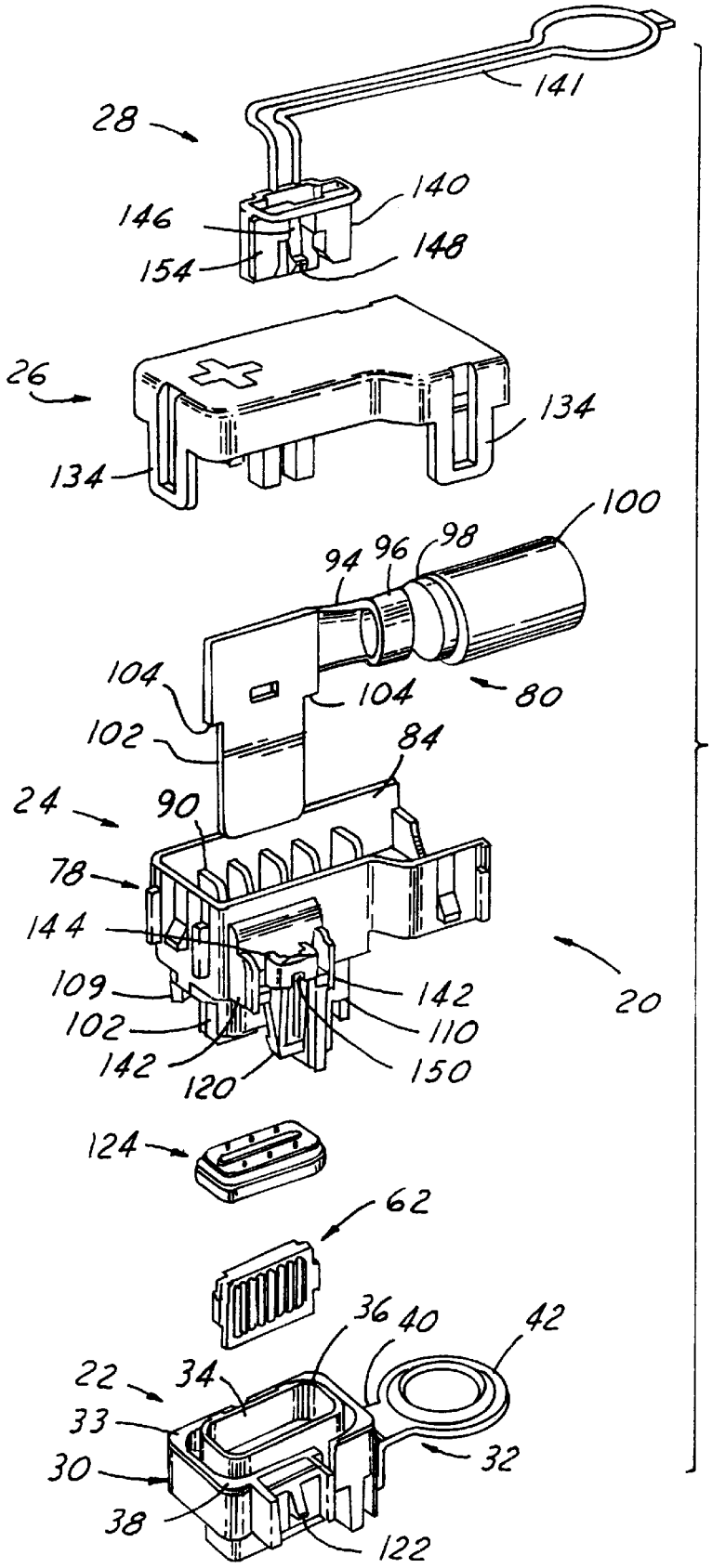
FIG. 1 is an exploded view of a direct connect power battery system constructed in accordance with this invention.
Figure 12:
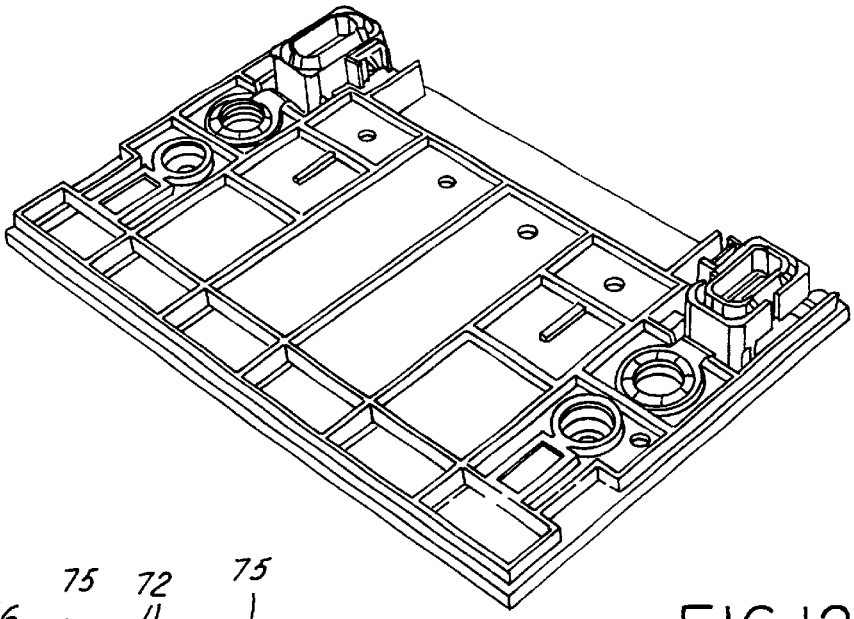
FIG. 12 shows a battery with an intermediate battery cover and two female connectors attached thereto, one female connector being a positive and the other a negative.
Figure 2:
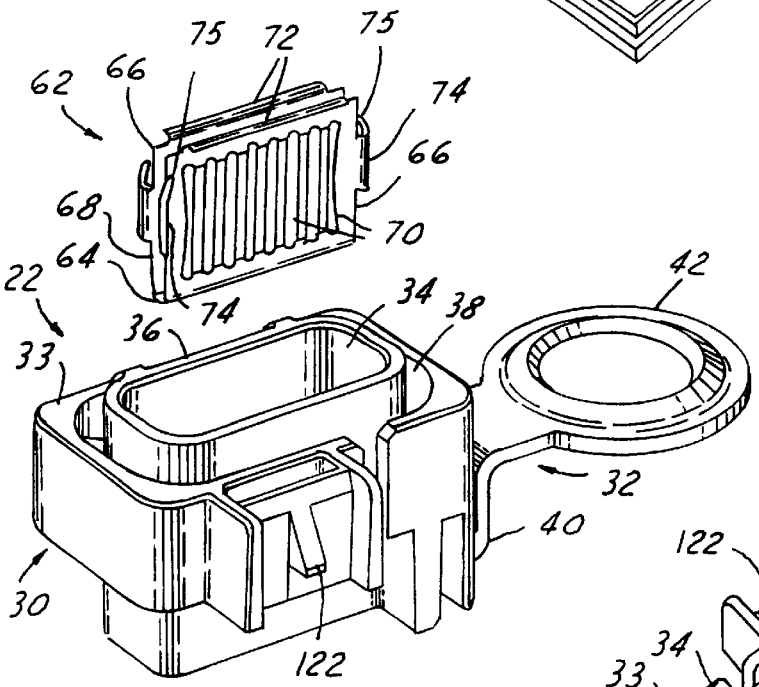
FIG. 2 is a perspective view showing the female connector including the female housing and contact member, the contact member being shown separated from the female housing.
Figure 3:
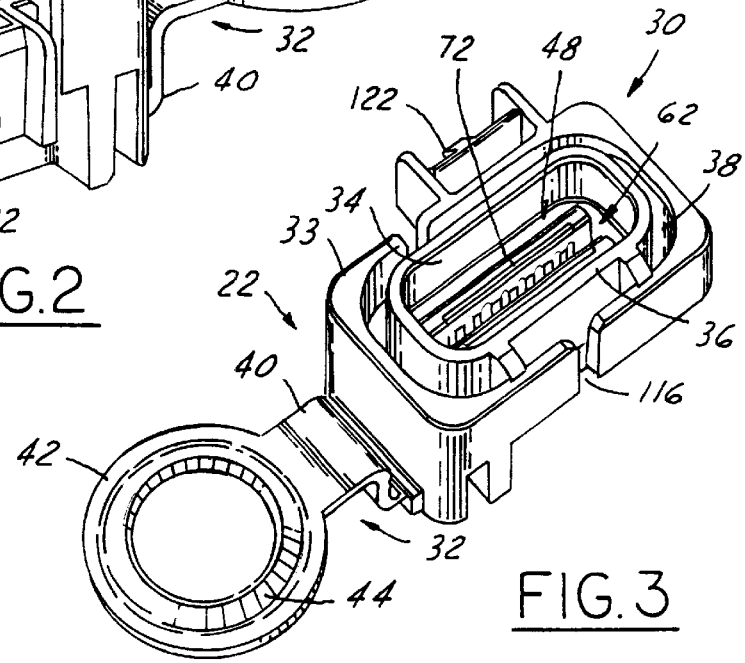
FIG. 3 is a perspective view showing the female housing from a different angle, and the contact member installed in the female housing.
Figure 4:
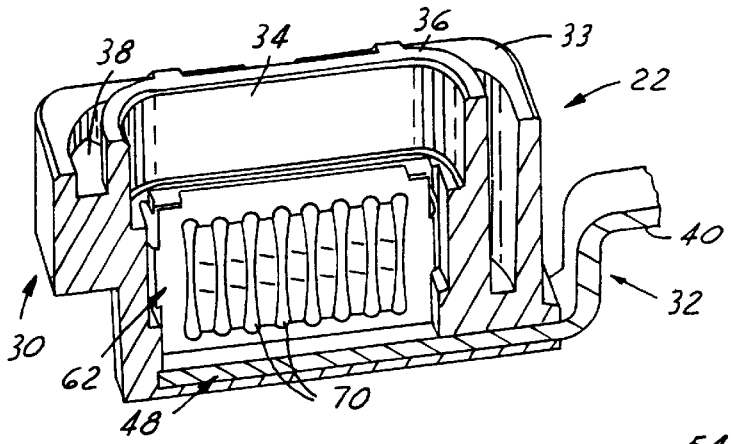
FIG. 4 is a sectional view of the female housing and contact member.
Figure 13:
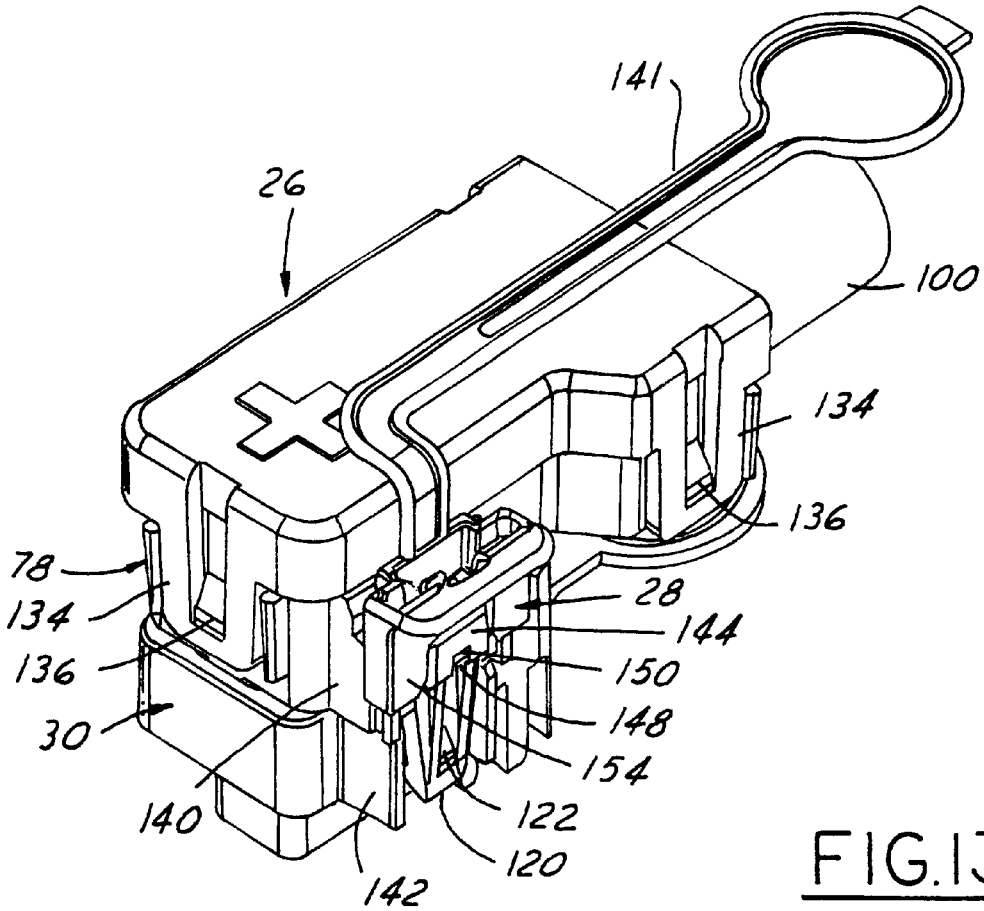
FIG. 13 is a perspective view of the assembled power battery system.

The power connector system 20 (FIGS. 1 and 13) of this invention comprises a female connector 22, a male connector 24, a cover 26, and a connection position assurance device (CPA) 28.

The female connector 22 includes a female housing 30 preferably made of plastic, and a metal female member 32 (FIGS. 1–4). The female housing 30 has an annular top surface 33, a central well 34 which is open at the top and defined by an annular wall 36 projecting above the top surface 33, and a groove 38 surrounding the wall 36. The female member 32 preferably comprises an electrically conductive metal stamping having an elongated bar 40 formed adjacent one end with an integral ring 42 provided with radially inwardly extending tabs 44 defining an opening for receiving a battery post, for example. At the opposite end of the female member 32, a female terminal 48 in the form of an integral upwardly opening, U-shaped channel 50 is provided. The channel has a base 52 and laterally spaced apart rectangular parallel side walls 54 extending upwardly from the base. The base and side walls of the channel 50 form a rectangular recess 56. The channel 50 is disposed in the well 34 inside the female housing 30. The ring 42 projects outside the female housing 30.

Figure 5:
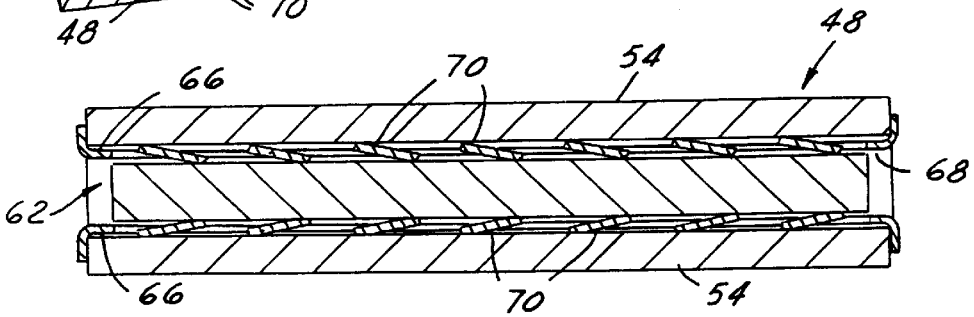
FIG. 5 is a sectional view taken on the line 5—5 in FIG. 10.
Figure 6:
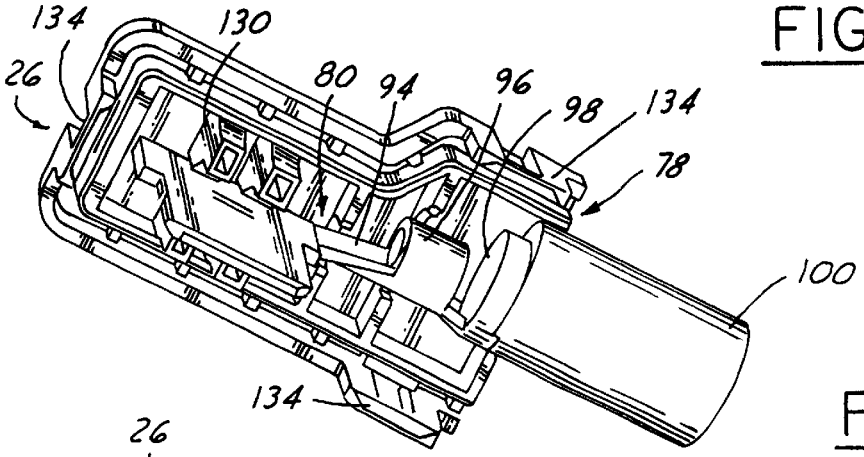
FIG. 6 is a perspective view showing the male terminal assembled with the male housing, and including a cover on the male housing.
Figure 7:
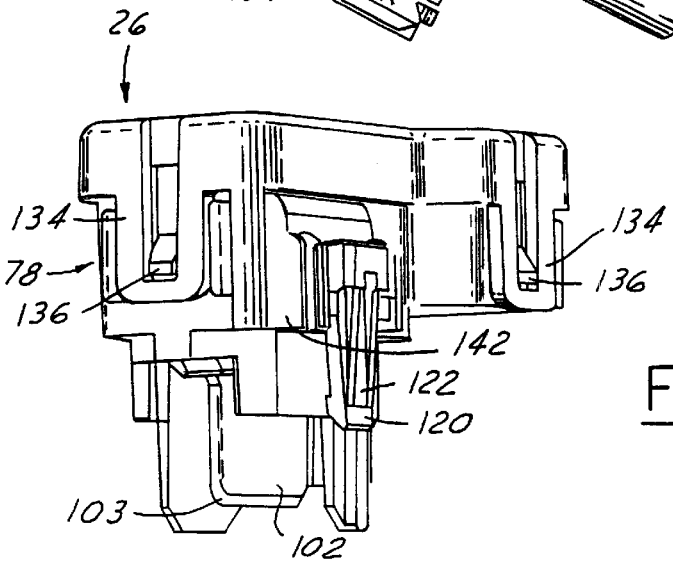
FIG. 7 is a perspective view of the structure in FIG. 6 as seen from a different angle.
Figure 8:
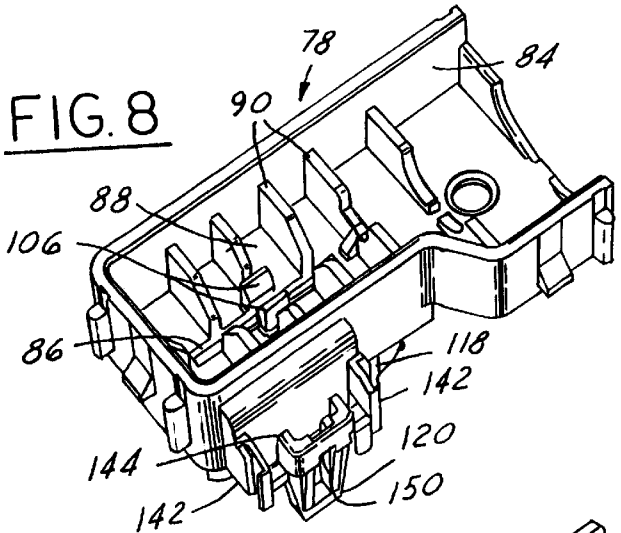
FIG. 8 is a perspective view of the male housing.
Figure 10:
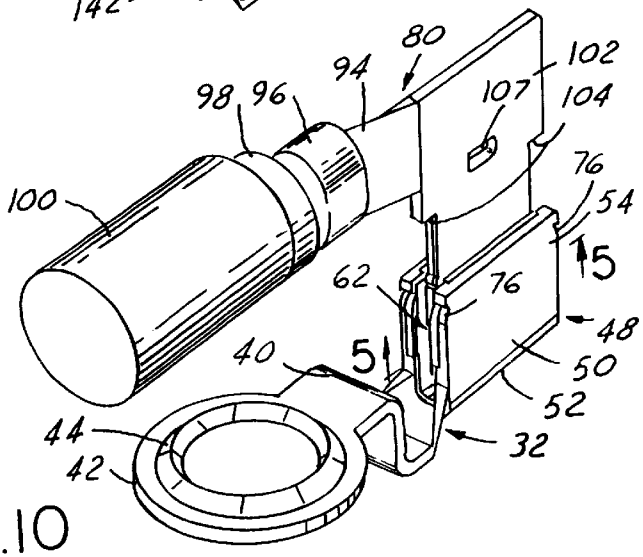
FIG. 10 is a perspective view showing the male and female terminals in contact with one another.

The female connector 22 also includes a contact member 62 (FIGS. 1,2 and 10) which is preferably an electrically conductive, U-shaped metal stamping having a base 64 and laterally spaced apart, rectangular parallel side walls 66 extending upwardly from the base. The base and side walls of the contact member 62 form a rectangular recess 68. Each of the side walls 66 of the contact member 62 is slotted at spaced points to form flexible webs 70 (FIG. 5) which arc twisted as shown to extend transversely of the plane of the side wall for contact with the sides walls of the channel 50 of the female member 32 as more fully described hereinafter. Along the outer edges of the two side walls 66 of the contact member 62 are laterally outwardly extending flanges 72. Along the end edges of each of the side walls 66 of the contact member 62 are laterally outwardly extending flanges 74 having inwardly inclined tabs 75.

The contact member 62 has a transverse dimension generally similar to the width of the recess 56 in the channel 50 of the female terminal so that the contact member may be inserted through the open top of the well 34 into the recess 56 with the base 64 of the contact member adjacent to the base 52 of the channel and the webs 70 of the side walls 66 of the contact member in electrical contact with the side walls 54 of the channel. When the contact member 62 is fully inserted into the recess 56, the flanges 72 along the outer edges of the side walls 66 of the contact member engage the outer edges of the side walls 54 of the channel, and the flanges 74 along the end edges of the side walls 66 of the contact member engage the end edges of the side walls 54 of the channel, with the tabs 75 engaging in notches 76 in the end edges of the side walls 54 to locate and releasably lock the contact member 62 within the recess 56 of the channel.

The male connector 24 includes a male housing 78 preferably made of plastic, and a male member 80 (FIGS. 1 and 6–9). The male housing 78 has an elongated open-top chamber 84. An elongated slot 86 is formed in the bottom wall 88 of the chamber, extending lengthwise thereof and located centrally between the opposite side walls of the chamber. Guide ribs 90 project upwardly from the bottom wall 88 of the chamber 84. The ribs 90 are arranged in laterally spaced pairs, with the ribs of each pair on opposite sides of the slot 86 and the pairs of ribs spaced apart longitudinally of the chamber. The rear of the male housing 78 is open to receive the male member 80.

The male member 80 is preferably an electrically conductive metal stamping and has an elongated bar 94 formed adjacent one end with two pairs of laterally spaced fingers 96 and 98 which are bent over an end of a cable 100 to secure the cable to the bar. The male member 80 has an integral male terminal in the form of a single blade 102 at the opposite end of the bar 94. The blade 102 extends perpendicular to the bar 94 and is an elongated, thin, flat plate-like member which is beveled at the free end 103 to facilitate its entry into the contact member 62 of the female connector 22. The bar 94 of the male member 80 extends into the chamber 84 of the male housing 78 through the rear of the male housing, and the blade 102 projects downwardly through the slot 86 in the bottom wall 88 of the chamber. The guide ribs 90 on opposite sides of the slot 86 receive and locate the blade 102. The blade 102 has shoulders 104 resting on the bottom wall 88 of the chamber 84 of the male housing 78 when the blade is fully inserted through the slot 86. Spring fingers 106 engage in a hole 107 in the blade 102 to releasably retain the blade fully inserted in the slot 86.

Guide ribs 109 and 110 project downwardly from the male housing beneath the bottom wall 88 of the chamber. The ribs 109, 110 enter the groove 38 in the female housing surrounding the well 34 to locate the male and female housings in proper relationship to one another. Slots 116 in the side wall of the female housing 30 receive ribs 118 on the male housing 78 also for locating purposes.

The male housing 78 has a flexible lock arm 120 sometimes called a pump handle lock arm, which is adapted to snap over a lock rib 122 on the female housing 30 to releasably secure the male and female housings together.

Figure 11:
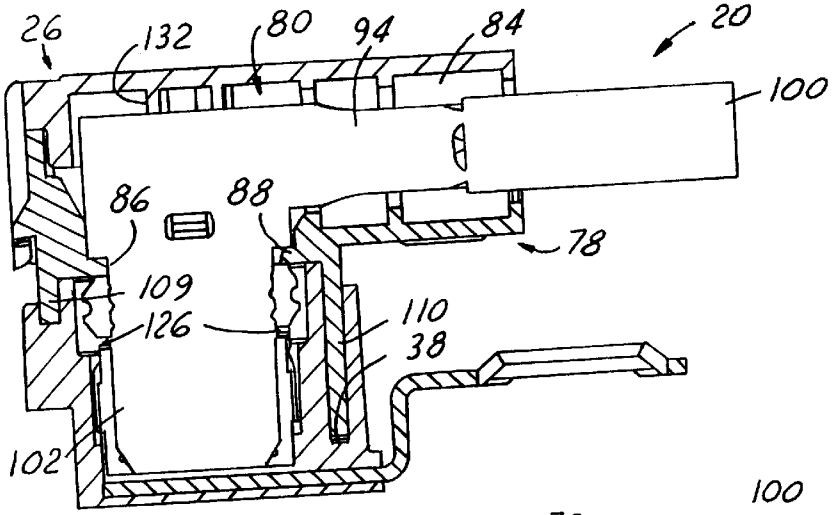
FIG. 11 is a sectional view of the direct connect power battery system completely assembled.
Figure 9:
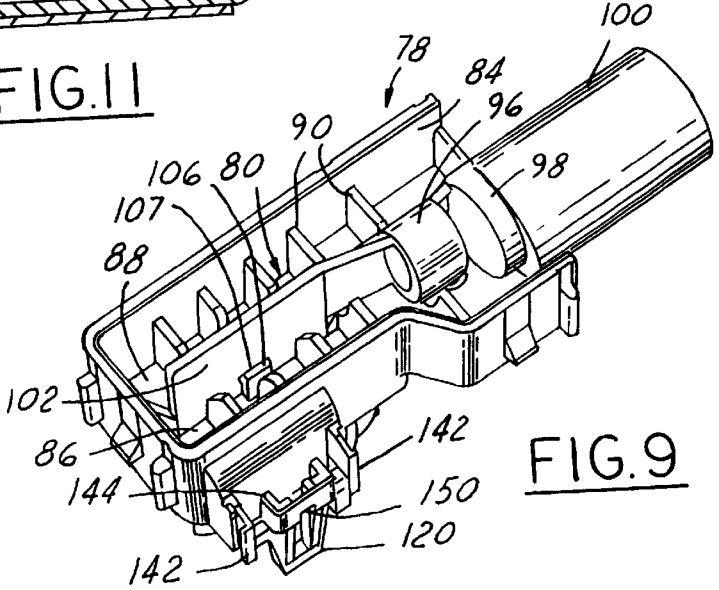
FIG. 9 is a perspective view showing the male housing at the same angle as FIG. 8, but with the male terminal installed in the male housing.

A sealing ring 124 (FIGS. 1 and 11) is sleeved on the blade 102. The sealing ring 124 seals against the blade and also against the bottom wall 88 of the chamber 84 in male housing 78 to prevent water from leaking from the male housing down through the slot 86. The sealing ring 124 is held on the blade and prevented from slipping off by nibs 126 on the blade.

The cover 26 (FIGS. 1, 6, 7 and 11) fits over and rests upon the male housing 78. Guide rails 130 spaced on opposite sides of the top of the blade 102 assist in aligning the cover to the male housing. Crush ribs 132 between the guide rails 130 will crush against the blade 102 when the cover is assembled on the male housing 78 to hold the blade tightly in place. The cover has flex locks 134 which are generally U-shaped and adapted to snap over lock ribs 136 on the male housing 78 to provide a releasable connection between the cover 26 and the male housing 78.

The connection position assurance device (CPA) 28 (FIGS. 1 and 13) has a hollow cap 140 on the end of a strap 141 which fits slidably over laterally spaced vertical guide rails 142 on the male housing 78. The male housing 78 has a generally U-shaped receiver 144 between the guide rails 142 which projects laterally outwardly from a side wall of the male housing. The CPA has a latch arm 146 which extends downwardly to a hook 148 at the free end. The hook 148 is adapted to engage in a recess 150 of the receiver 144 to releasably attach the CPA to the male housing. The outer wall 154 of the cap, when the cap is latched onto the male housing 78, extends over the latch arm 120 on the male housing to prevent the latch arm from being flexed outward far enough to disengage the lock rib 122 on the female housing. Thus, when the CPA is latched on the male housing 78, the male housing cannot be separated from the female housing.

What is claimed is:

1. An electrical power connector system comprising:

a female connector including a female housing a female member having a female terminal in said female housing, said female terminal having walls defining a first recess, and a contact member in said first recess in contact with the walls thereof, said contact member having walls defining a second recess, a male connector including a male housing, and a male member having a male terminal in the form of a single blade in said male housing, and means releasably connecting said male housing to said female housing with said single blade of said male terminal extending into said second recess in contact with the walls of the contact member defining the second recess.

2. An electrical power connector system as defined in claim 1, wherein said male housing has guide means receiving and locating said blade.

3. An electrical power connector system as defined in claim 1, further including latch means in said male housing releasably engaging said blade.

4. An electrical power connector system as defined in claim 1, further including a top cover releasably secured to said male housing.

5. An electrical power connector system as defined in claim 4, wherein said cover has crush ribs that crush against said blade and hold said blade firmly in place.

6. An electrical power connector system as defined in claim 1, further including means for preventing said male housing from being separated from said female housing.

7. An electrical power connector comprising:

a female connector including a female housing, a female member having a female terminal releasably received in said female housing, said female terminal being generally in the form of a generally U-shaped channel defined by a base and laterally spaced apart side walls extending outwardly from said base to form a first recess, and a generally U-shaped contact member having a base and laterally spaced apart side walls extending outwardly therefrom to form a second recess, said contact member being releasably received in said first recess of said channel with the base of said contact member adjacent the base of said channel and the side walls of said contact member in contact with the respective side walls of said channel, a male connector including a male housing and a male member having a male terminal in the form of a single blade releasably received in said male housing; and means releasably connecting said male housing to said female housing with said blade extending into said second recess in contact with the side walls of said second recess.

8. An electrical power connector system as defined in claim 7, and further including a sealing ring sleeved on said blade and in contact with said male housing to prevent leakage from said male housing.

9. An electrical power connector system as defined in claim 8, further including nibs projecting outwardly from said blade and engaging said sealing ring to prevent said sealing ring from slipping off said blade.

10. An electrical power connector system as defined in claim 7, wherein said male housing has guide means receiving and locating said blade.

11. An electrical power connector system as defined in claim 7, further including latch means in said male housing releasably engaging said blade.

12. An electrical power connector system as defined in claim 7, further including a top cover releasably secured to said male housing.

13. An electrical power connector system as defined in claim 12, further including a connection position assurance device releasably secured to said male housing, said device having means engaging the means releasably connecting said male housing to said female housing for preventing separation of said male and female housings.

14. An electrical power connector system as defined in claim 13, wherein said cover has crush ribs that crush against said blade and hold said blade firmly in place.

15. An electrical power connector system as defined in claim 14, further including latch means in said male housing releasably engaging said blade.

16. An electrical power connector system as defined in claim 15, and further including a sealing ring sleeved on said blade and in contact with said male housing to prevent leakage from said male housing.

17. An electrical power connector system comprising:

a female connector including a female housing, a female member having a female terminal releasably received in said female housing, said female terminal being generally in the form of a generally U-shaped channel defined by a base and laterally spaced apart side walls extending outwardly from said base to form a first recess, and a generally U-shaped contact member having a base and laterally spaced apart side walls extending outwardly therefrom to form a second recess, said contact member being releasably received in said first recess of said channel with the base of said contact member adjacent the base of said channel and the side walls of said contact member in contact with the respective side walls of said channel, a male connector including a male housing, a male member having a male terminal in the form of a single blade releasably received in said male housing and latch means in said male housing releasably engaging said blade, means releasably connecting said male housing to said female housing with said blade extending into said second recess in contact with the side walls of said second recess;

a connection position assurance device releasably secured to said male housing, said device having means for preventing separation of said male and female housings;

a top cover releasably secured to said male housing; said cover having crush ribs that crush against said blade and hold said blade firmly in place, a sealing ring sleeved on said blade and in contact with said male housing to prevent leakage from said male housing, and nibs projecting outwardly from said blade and engaging said sealing ring to prevent said sealing ring from slipping off said blade.

* * * * *